US006151002A

United States Patent [19]

Kim

[11] Patent Number: 6,151,002

[45] Date of Patent: Nov. 21, 2000

[54] DISPLAY DEVICE AND CONVERTING APPARATUS THEREOF

[75] Inventor: Kuy Tae Kim, Kyungki-do, Rep. of Korea

[73] Assignee: Hyundai Electronics Industries Co., Ltd., Ichon-shi, Rep. of Korea

[21] Appl. No.: 08/961,251

[22] Filed: Oct. 30, 1997

[30] Foreign Application Priority Data

Oct. 30, 1996 [KR] Rep. of Korea ..... 96-49963

[51] Int. Cl.[7] ..... G09G 3/36

[52] U.S. Cl. ..... 345/87; 345/132

[58] Field of Search ..... 345/87, 88, 112, 345/132, 138, 471

[56] References Cited

U.S. PATENT DOCUMENTS 4,386,528 6/1983 Engle ..... 358/112
4,785,818 11/1988 Hardin ..... 128/660.07
5,448,260 9/1995 Zenda et al. .
5,481,275 1/1996 Mical et al. ..... 345/132
5,500,654 3/1996 Fujimoto ..... 345/132
5,612,715 3/1997 Karaki et al. ..... 345/132
5,703,622 12/1997 Evans et al. ..... 345/154
5,883,613 3/1999 Iwaki ..... 345/132

*Primary Examiner*—Richard A. Hjerpe
*Assistant Examiner*—Ronald Laneau
*Attorney, Agent, or Firm*—Fleshner & Kim, LLP

[57] ABSTRACT

A system for displaying an image converts an input pixel data for output onto a display device of a different resolution. An apparatus outputs a plurality of first pixel data of the input resolution. A converting apparatus assigns at least one of a plurality of weighted values and partially amplifies the plurality of first pixel data to output a plurality of second pixel data. The display device is coupled to the converting apparatus to receive the plurality of second pixel data, and the display device displays the image of a second prescribed resolution based on the plurality of second pixel data.

24 Claims, 6 Drawing Sheets

DISPLAY DEVICE AND CONVERTING APPARATUS THEREOF

BACKGROUND OF THE INVENTION

1. Field of the Invention

The present invention relates to a display device, and more particularly, a data converting apparatus for a display device.

2. Background of the Related Art

Contrary to a common monitor where analog signals are input, digital signals corresponding to a display resolution are input in a general liquid crystal display (LCD) device. However, when data is transmitted by a connection between systems, the display format should be converted due to difference between a resolution of an input image data and a resolution of an LCD screen.

FIG. 1 shows a diagram of a conventional LCD device and FIG. 2 shows a state of a display when a low resolution screen is realized using a partial cell expansion of the conventional technology. A color LCD display control system similar to FIG. 1 is illustrated in U.S. Pat. No. 5,448,260.

When an LCD device is a VGA having the resolution of 640×480, no problem occurs due to a resolution difference between the input image data and the image displayed on the LCD device. However, in the case of a high resolution of 800×600, 1024×768 and 1280×1024, the conversion of a low resolution input image data to a high resolution display format is difficult, because the ratio of resolutions between the LCD device and image data are not an integral proportion.

A method to solve the above problems in converting the display format is to display an image by partially using a display area of an LCD screen, not the overall area. FIG. 1 shows a display an image using a partial display area of an LCD screen. Since the number of pixels is small, the screen display area is partially used to display a low resolution image data.

In FIG. 1, the image data of 640×480 is displayed in an LCD device having a resolution of 800×480. Here, the ratio of a screen usage is 64%. Each of the column drivers and gate drivers selectively outputs a driving signal in accordance with a column control signal and a gate control signal, respectively, provided from a controller to display the low resolution RGB image data from a system, e.g., a personal computer. The display format converting method of FIG. 1 is the same as that of performing a display through assignment by the controller a start point and an end point in accordance with a resolution of image data input as 800×600 pixels. Accordingly, the pixels at a peripheral portion of an LCD screen display area are selectively used to display the input image data.

In the display format converting method described above, the screen of the LCD is inefficiently used. When image data having a 640×480 resolution is displayed on the LCD having an 800×600 resolution, only 64% of the LCD screen area is used.

Another method to solve the above problems is to reconstruct the screen and displaying the same using a CPU or a VGA chip in a video card driver or a video card. FIG. 2 shows a conversion of a display format by partially amplifying a cell. When a RGB image data having a resolution of 640×480 is displayed on an LCD device having an 800×600 display resolution, the ratio of resolution is 5:4. However, in this method, the image data corresponding to a single cell among arbitrary four cells of a 640×480 mode is amplified twice to convert the image data for display as a 800×600 display format.

In the second method of displaying by amplifying twice the image data of the arbitrary number of pixels, the quality of an image is deteriorated due to the difference between an amplified pixel and the neighboring pixels. As shown in FIG. 2, in a converted image where a particular pixel in an original image is amplified, a portion having the amplified pixel seems much darker.

The above references are incorporated by reference herein where appropriate for appropriate teachings of additional or alternative details, features and/or technical background.

SUMMARY OF THE INVENTION

An object of the present invention is to substantially obviate one or more of the problems due to limitations and disadvantages of the related art.

Another object of the present invention is to efficiently convert a display format according to a resolution of a display device.

A further object of the present invention is to convert the display format by giving a weight value to each pixel or by partial amplification.

The present invention may be achieved in parts or in a whole by a system for displaying an image, comprising an apparatus that outputs a plurality of first pixel data of a first prescribed resolution; a converting apparatus coupled to the system, the converting apparatus assigning at least one of a plurality of weighted values and partially amplifying the plurality of first pixel data to output a plurality of second pixel data; and a display device coupled to the converting apparatus to receive the plurality of second pixel data, the display device displaying the image of a second prescribed resolution based on the plurality of second pixel data.

The present invention may be also achieved in parts or in a whole by a converting apparatus for converting a plurality of pixel data for a first resolution to a plurality of pixel data for a second resolution of a display device, comprising a data loading circuit to receive the plurality of first pixel data; a conversion circuit coupled to the data loading circuit, the conversion circuit assigning at least one of a plurality of weighted values and partially amplifying the plurality of first pixel data to output a plurality of second pixel data; and a data output circuit coupled to the conversion circuit to receive the plurality of second pixel data for output to the display device.

The present invention may be achieved by a method of converting a plurality of pixel data for a first display having a first resolution to a plurality of second pixel data for a second display having a second resolution, the method comprising the steps of assigning a weighted value to the plurality of first pixel data to output the plurality of second pixel data in a first direction of the second display; and partially amplifying the plurality of first pixel data to output the plurality of second pixel data in a second direction of the second display.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

In a display format conversion of the present invention, the input RGB data format is converted to the resolution ratio of a display device. An output image data is not integrally proportional, but a weighted value is assigned to each pixel such that the of image quality is not lowered. Specifically, when an image of a low resolution mode is represented on a high resolution LCD device, a weighted value is assigned to the input image data in a horizontal direction and the input image data is partially amplified in a vertical direction to raise the resolution. Further, the display of the image can be possible without changing the PC interface device.

Figure 1:
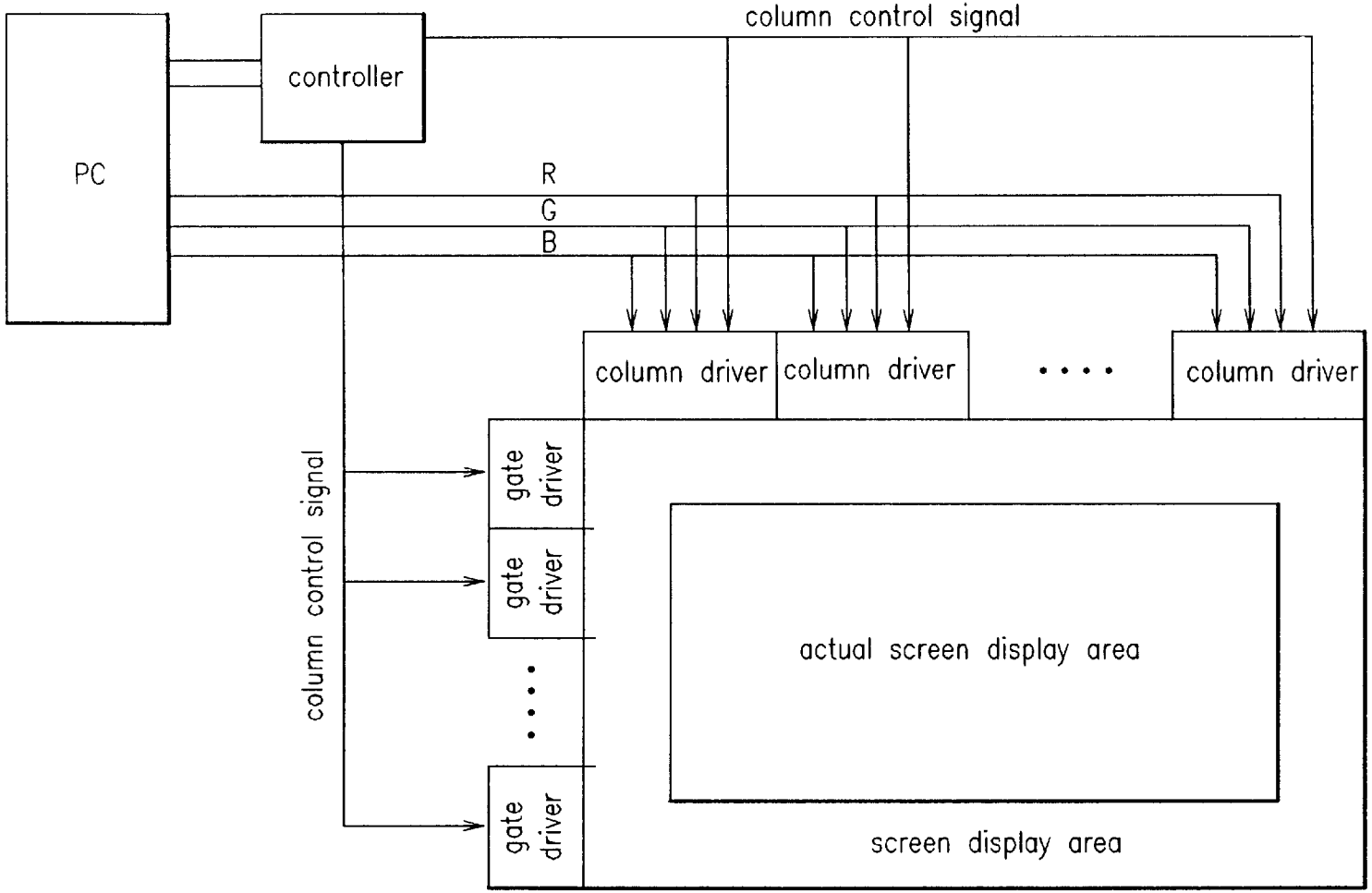
FIG.1 prior art
FIG. 1 is a diagram of a related LCD device.
Figure 2:
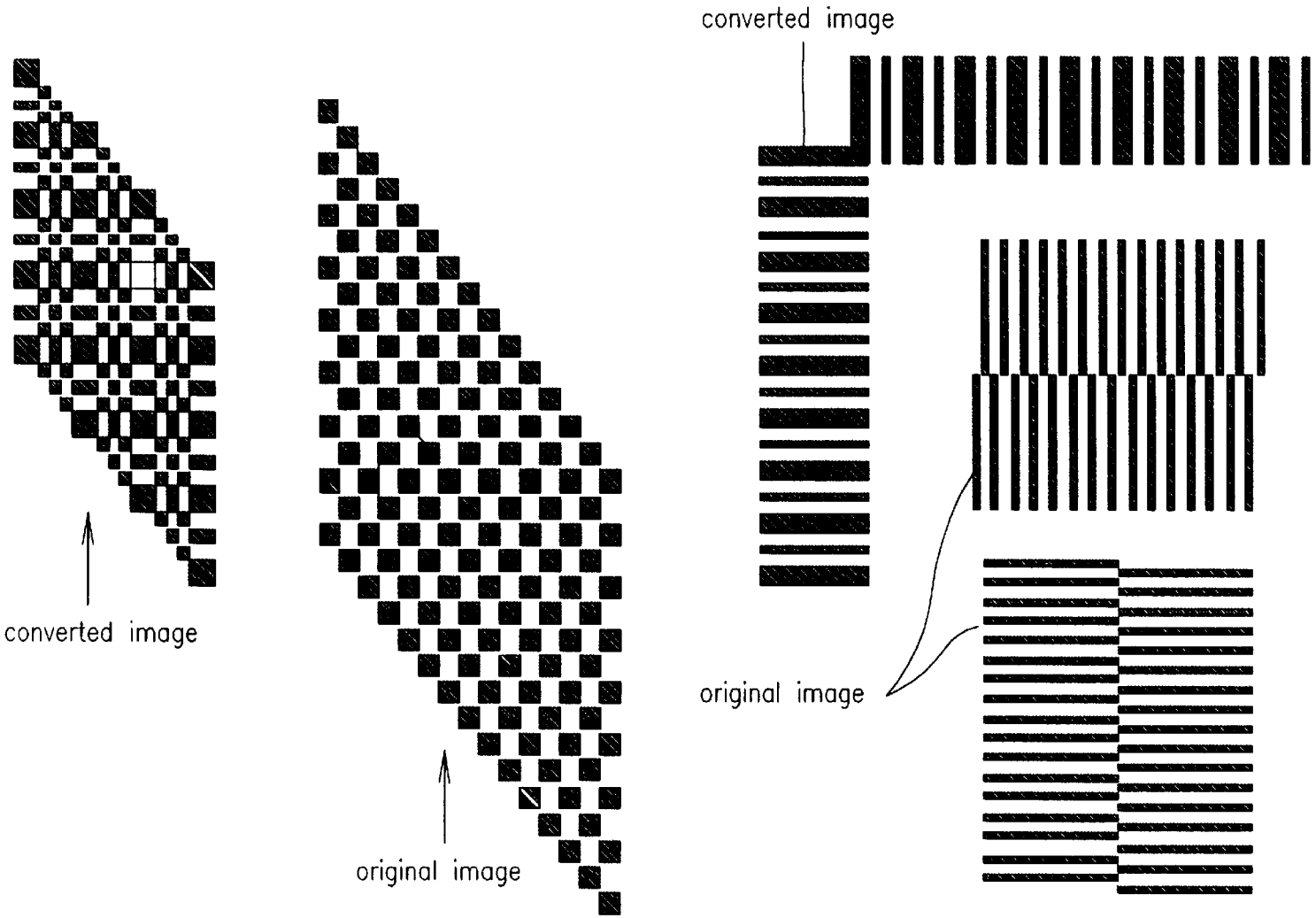
FIG.2 prior art
FIG. 2 is a view showing a state of a display when an image of a low resolution is embodied by integral cell expansion.
Figure 3:
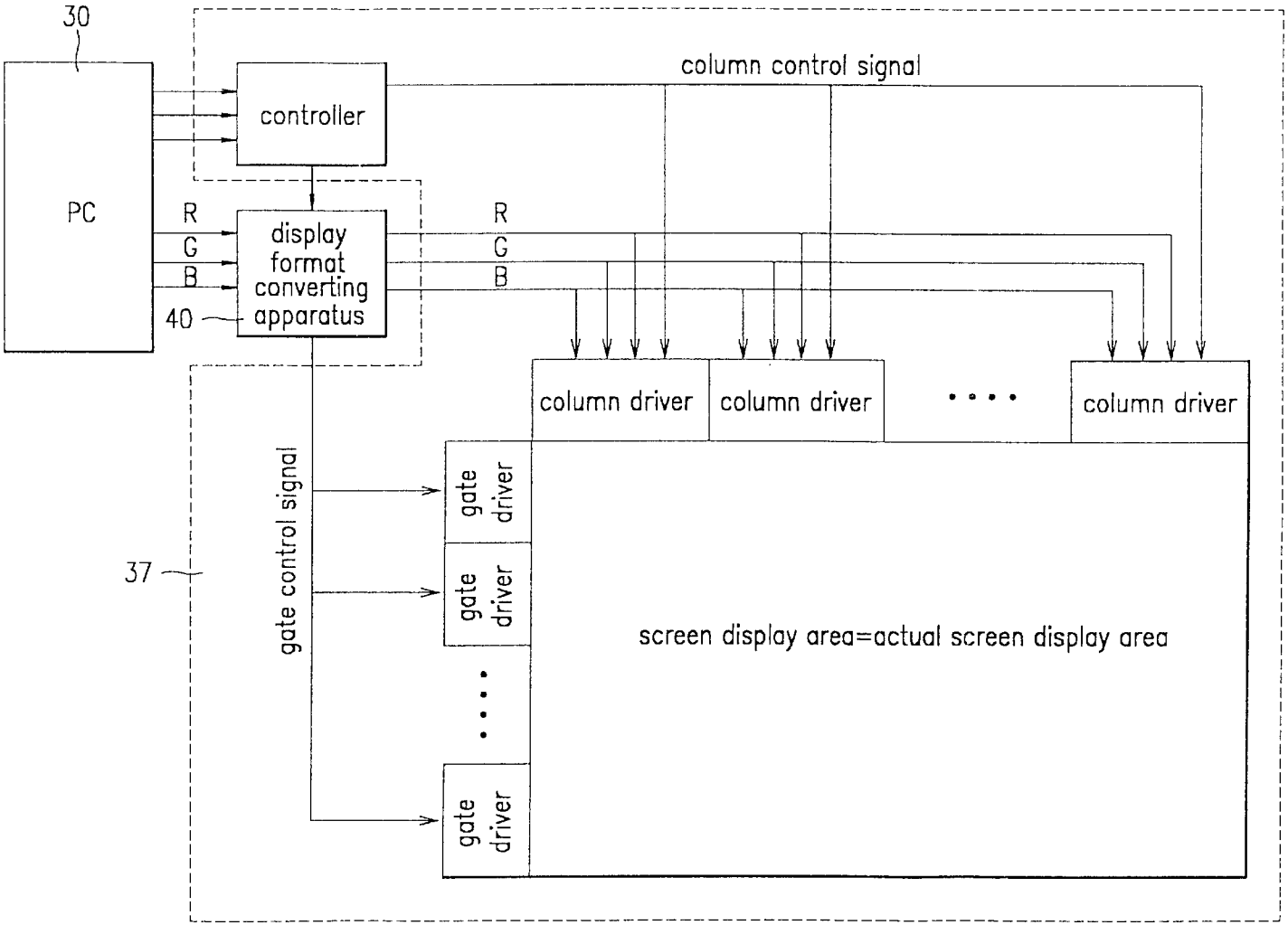
FIG. 3 is a diagram showing an LCD according to a preferred embodiment of the present invention.

FIG. 3 illustrates a diagram of the LCD device in accordance with a preferred embodiment of the present invention. As shown, the present invention includes a display format converting apparatus 40 to convert an input RGB image data to an appropriate format for the output RGB image data. For example, the display format converting apparatus converts an input RGB image data for 640×480 resolution into an output RGB image data for 800×600 resolution, which is generally used in apparatuses including personal computers (PCS) and notebook computers with high pixel resolution.

For both the horizontal direction and the vertical direction, the ratio is 5:4, i.e., 800:600 in the horizontal direction and 600:480 in the vertical direction. In order to display the input data, a 4×4 pixel of the input RGB image data is converted into a 5×5 pixel of the output RGB image data. The display format converting apparatus 40 of the present invention converts, for example, the following 4×4 pixel data of the 640×480 resolution, $$\begin{bmatrix} a_{00} & a_{01} & a_{02} & a_{03} \\ a_{10} & a_{11} & a_{12} & a_{13} \\ a_{20} & a_{21} & a_{22} & a_{23} \\ a_{30} & a_{31} & a_{32} & a_{33} \end{bmatrix}$$

into the following 5×5 pixel data of the 800×600 resolution.

$$\begin{bmatrix} b_{00} & b_{01} & b_{02} & b_{03} & b_{04} \\ b_{10} & b_{11} & b_{12} & b_{13} & b_{14} \\ b_{20} & b_{21} & b_{22} & b_{23} & b_{24} \\ b_{30} & b_{31} & b_{32} & b_{33} & b_{34} \\ b_{40} & b_{41} & b_{42} & b_{43} & b_{44} \end{bmatrix}$$

In the preferred embodiment, the display format converting apparatus 40 assigns prescribed weighted values to the pixel data in the horizontal direction, and partially amplifies the pixel data in the vertical direction. For example, the following weighted values are assigned to pixel data $b_{yx}$ in the horizontal direction, where y=0 and x=0–4:

$b_{00}=a_{00}$;

$b_{01}=\frac{1}{4}a_{00}+\frac{3}{4}a_{01}$;

$b_{02}=\frac{1}{2}a_{01}+\frac{1}{2}a_{02}$;

$b_{03}=\frac{3}{4}a_{02}+\frac{1}{4}a_{03}$; and $b_{04}=a_{03}$.

For pixel data $b_{yx}$ (x=0 and y=0–4) of the 5×5 pixels in the vertical direction, the display format converting apparatus 40 partially amplifies the pixel data $a_{yx}$ (x=0 and y=0–3) of the 4×4 pixels based on the following preferred rule:

$b_{00}=a_{00}$;

$b_{10}=a_{00}$;

$b_{20}=a_{10}$;

$b_{30}=a_{20}$; and $b_{40}=a_{30}$.

To achieve the weighted values in the horizontal direction and partial amplification in the vertical direction, the entire 4×4 pixel is converted by Ty=a prescribed partial amplification conversion factor in the Y-axis and by Tx=a prescribed weighted value conversion factor in the X-axis, as follows.

$$TyATx = \begin{bmatrix} 1 & 0 & 0 & 0 \\ 1 & 0 & 0 & 0 \\ 0 & 1 & 0 & 0 \\ 0 & 0 & 1 & 0 \\ 0 & 0 & 0 & 1 \end{bmatrix} \begin{bmatrix} a_{00} & a_{01} & a_{02} & a_{03} \\ a_{10} & a_{11} & a_{12} & a_{13} \\ a_{20} & a_{21} & a_{22} & a_{23} \\ a_{30} & a_{31} & a_{32} & a_{33} \end{bmatrix} \begin{bmatrix} 1 & 1/4 & 0 & 0 & 0 \\ 0 & 3/4 & 1/2 & 0 & 0 \\ 0 & 0 & 1/2 & 3/4 & 0 \\ 0 & 0 & 0 & 1/4 & 1 \end{bmatrix}$$

Based on such a conversion, the display format converting apparatus 40 outputs the following 5×5 pixel data of the RGB image data to the LCD panel 37.

$$\begin{bmatrix} b_{00} & b_{01} & b_{02} & b_{03} & b_{04} \\ b_{10} & b_{11} & b_{12} & b_{13} & b_{14} \\ b_{20} & b_{21} & b_{22} & b_{23} & b_{24} \\ b_{30} & b_{31} & b_{32} & b_{33} & b_{34} \\ b_{40} & b_{41} & b_{42} & b_{43} & b_{44} \end{bmatrix} =$$

$$\begin{bmatrix} a_{00} & \frac{a_{00}+3a_{01}}{4} & \frac{a_{01}+a_{02}}{2} & \frac{3a_{02}+a_{03}}{4} & a_{03} \\ a_{00} & \frac{a_{00}+a_{01}}{4} & \frac{a_{01}+a_{02}}{2} & \frac{3a_{02}+a_{03}}{4} & a_{03} \\ a_{10} & \frac{a_{10}+3a_{11}}{4} & \frac{a_{11}+a_{12}}{2} & \frac{3a_{12}+a_{13}}{4} & a_{13} \\ a_{20} & \frac{a_{20}+3a_{21}}{4} & \frac{a_{21}+a_{22}}{2} & \frac{3a_{22}+a_{23}}{4} & a_{23} \\ a_{30} & \frac{a_{30}+3a_{31}}{4} & \frac{a_{31}+a_{32}}{2} & \frac{3a_{32}+a_{33}}{4} & a_{33} \end{bmatrix}$$

Figure 4:
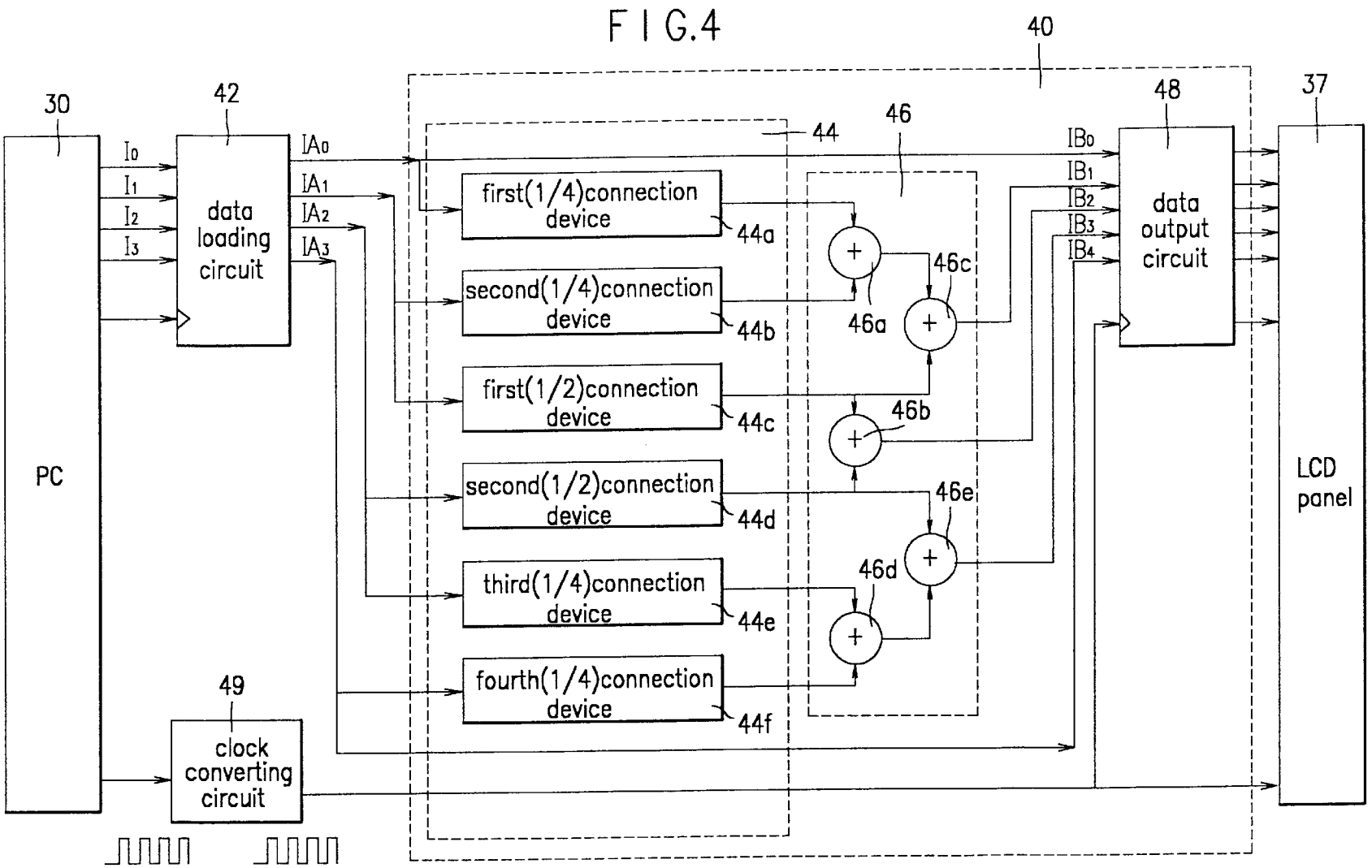
FIG. 4 is a block diagram showing a format converting apparatus of FIG. 3.

FIG. 4 illustrates a block diagram of the display format converting apparatus 40 to achieve the above conversion. A data loading circuit 42 serially loads the input pixel data $a_{yx}$ of the RGB data from a PC via a plurality of bus lines $I_0$–$I_3$ based on a clock signal from the PC. The data loading circuit 42 outputs in parallel the pixel data $a_{yx}$ to a plurality of bus lines $IA_0$–$IA_3$ for input to a conversion circuit 45 which includes a connection circuitry 44 and a arithmetic unit such as a data adding circuit 46. The circuitry 44 includes a plurality of connection devices 44*a*–44*e*, which shifts the corresponding input pixel data $a_{yx}$ to assign a prescribed weighted value, e.g., ¼ or ½, of the input pixel data $a_{yx}$. The data adding circuit 46 includes a plurality of adders 46*a*–46*e* that adds the corresponding outputs of the connection circuitry 44, and that outputs the pixel data $b_{yx}$ onto bus lines $IB_0$–$IB_4$.

A data output circuit 48 loads the pixel data $b_{yx}$ in parallel based on a converted clock signal from a clock converting circuit 49, which is needed in the preferred embodiment to change the clock signal for 4×4 pixels into the converted clock signal for 5×5 pixels. Thereafter, based on the converted clock signal, the pixel data for the output RGB data is inputted into the LCD panel 37. For illustrative purposes, a phase lock loop (PLL) may be used for the clock converting circuit 49. Further, the construction of the adders is known to one of ordinary skill in the art, and a description thereof is omitted.

Figure 5:
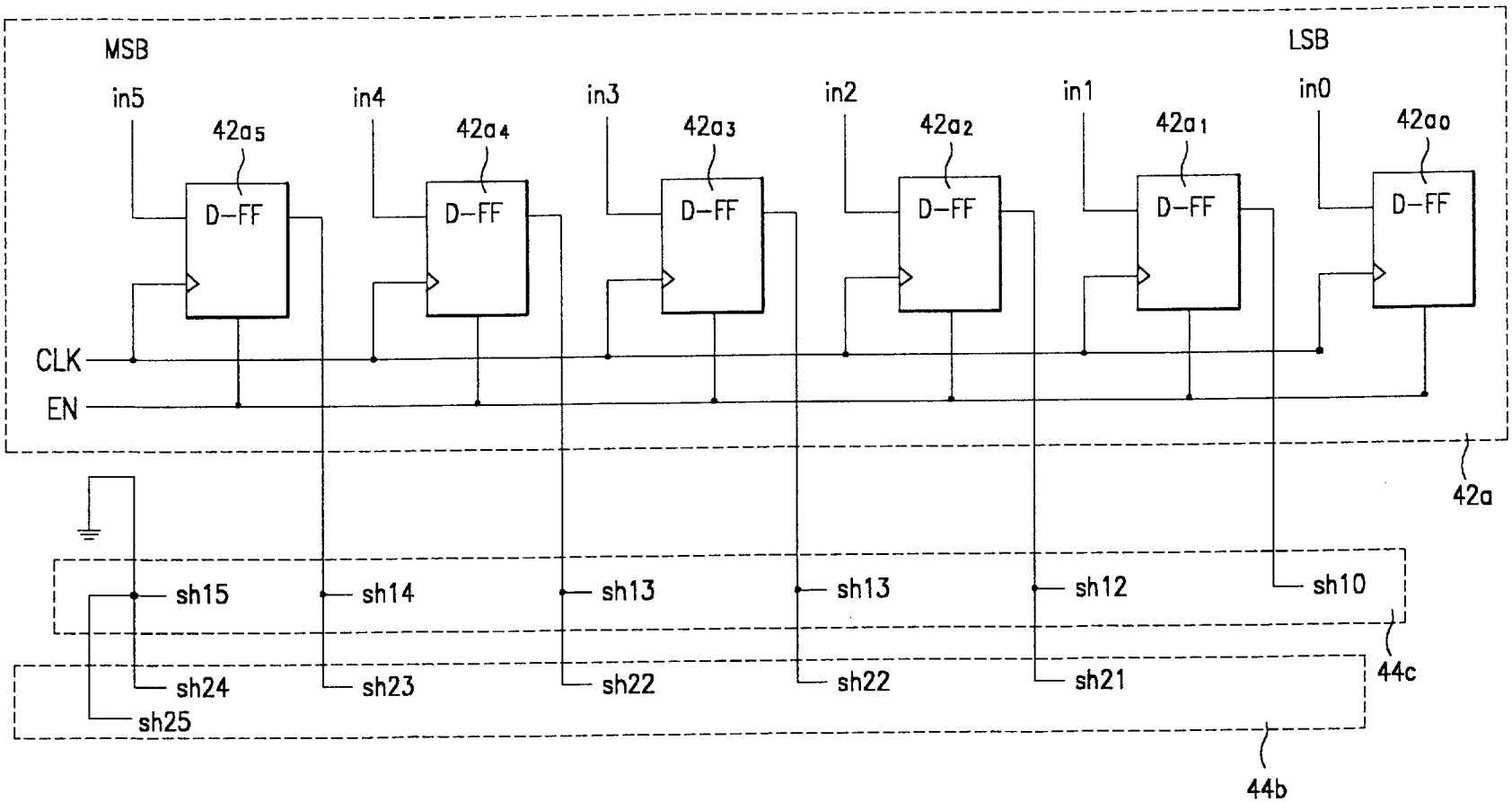
FIG. 5 is a block diagram showing in detail a data loading circuit and a connection circuitry of the format converting apparatus illustrated in FIG. 4.
Figure 6:
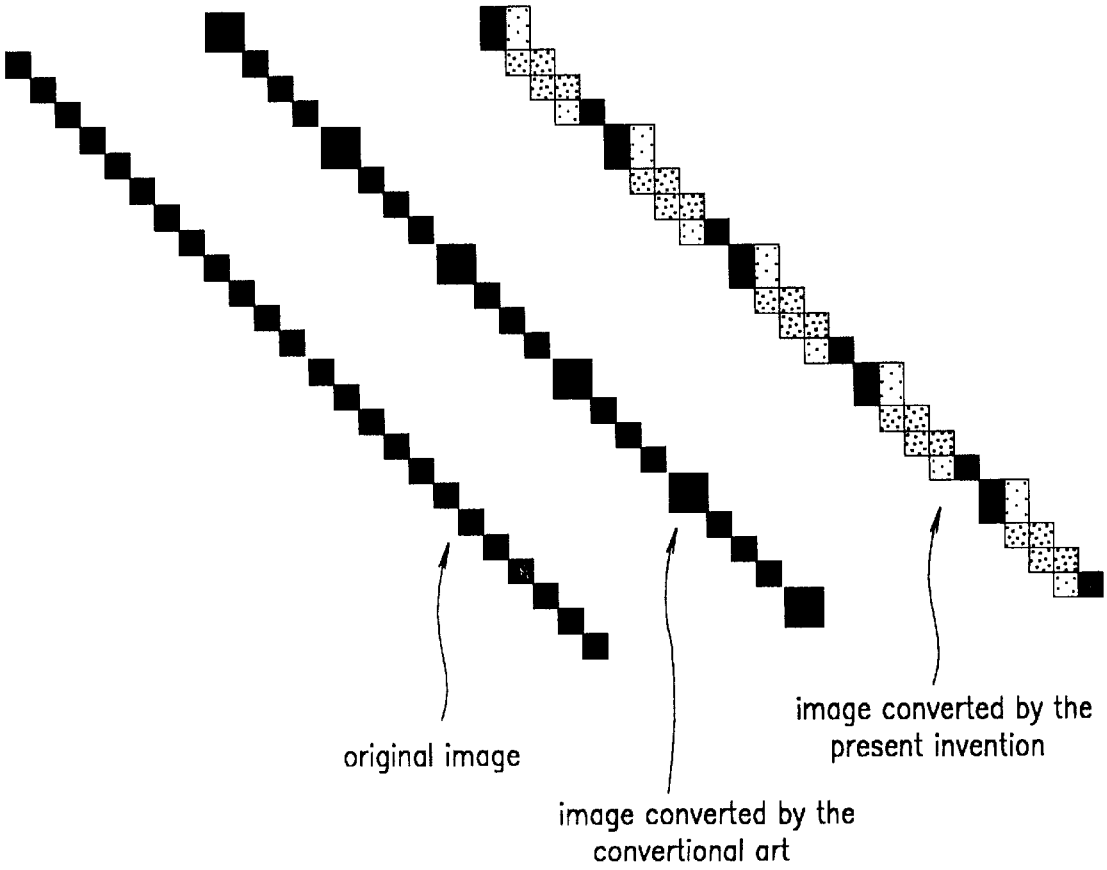
FIG. 6 is a view showing a display state of the present invention.

FIG. 5 illustrates a detailed partial schematic of the a data loading device 42*a* of the data loading circuit 42 for pixel data inputted on the bus line $I_1$ and the connection devices 44*c* and 44*b* coupled to the bus line $IA_1$. As shown, the bus line $I_1$ comprises six (6) data lines in0–in5 to receive the six (6) bit pixel data from the least significant bit (LSB) to the most significant bit (MSB). As can be appreciated, the number of bits for the pixel data $a_{yx}$ may be different based on the design requirements or the technology.

The data loading device 42*a* comprises a plurality of latches or storage devices, preferably D flip-flops 42*a*$_0$–42*a*$_5$, each loading a corresponding bit of the pixel data from data lines in0–in5 of the bus line $I_1$ and outputting the pixel data on the bus line IA1 in response to the clock signal CLK and the enable signal EN. FIG. 5 discloses the data loading device 42*a* of the data loading circuit 42 to receive the pixel data on the bus line I1. As can be appreciated, the data loading circuit 42 comprises a plurality of data loading devices coupled to the bus lines $I_0$–$I_3$, and each loading device comprises a plurality of flip-flops to receive the corresponding 6-bit pixel data $a_{yx}$ on a corresponding bus line $I_0$, $I_1$, $I_2$ and $I_3$.

The outputs of the flip-flops 42*a*0–42*a*$_5$ are coupled to the connection devices 44*c* and 44*b* by the bus line $IA_1$. To achieve the shifting of the stored pixel data in the flip-flops by one, the connection device 44*c* comprises a network of data line connections sh10–sh15, where the least significant bit of the shifted pixel data is from the flip-flop 42*a*$_1$ coupled to the data line connection sh10, and the most significant bit of the shifted pixel data is coupled to ground via data line sh15. Similarly, the connection device 44*b* comprises a network of data line connections sh20–sh25, where the least significant bit of the twice shifted pixel data is from the flip-flop 42*a*$_2$ coupled to the data line connection sh20 and the most significant bits of the twice shifted pixel data is coupled to ground via data lines sh25 and sh24.

For example, if the pixel data $a_{01}$ having a binary value of "1 0 1 0 0 0" (decimal value of 40) is loaded into the flip-flops 42*a*$_1$–42*a*$_5$ from the bus line $I_1$, the once shifted pixel data on data line connections sh10–sh15 of connection device 44*c* equals "0 1 0 1 0 0" (decimal value of 20, i.e., ½ $a_{01}$), and the twice shifted pixel data on data line connection sh20–sh25 of connection device 44*b* equals "0 0 1 0 1 0" (decimal value of 10, i.e., ¼ $a_{01}$).

The connection devices 44*a*, 44*e* and 44*f* are coupled to corresponding sets of flip-flops in the data loading circuit 42 via bus lines $IA_0$, $IA_2$ and $IA_3$, and have similar network of data line configurations as the connection device 44*b* to shift the pixel data once. Likewise, the connection device 44*d* is coupled to a corresponding set of flip-flops in the data loading circuit 42 via a bus line $IA_2$ and has a similar network of data line configurations as the connection device 44*c*. As can be appreciated, shifters, for example, may be also used instead of the connection devices to achieve the shifting operation.

The adders 46*a*–46*e* of the data adding circuit 46 add the outputs of the connection devices 44*a*–44*f* to provide output pixel data on the bus lines $IB_1$–$IB_4$. As shown, the pixel data on bus line $IA_0$ is directly transferred to the bus line $IB_0$, and pixel data on the bus line $IA_3$ serves as the output pixel data on the bus line $IB_4$. The output pixel data $b_{yx}$ on the bus lines $IB_0$–$IB_4$. are loaded into the data output circuit 48 and are outputted to the LCD panel 37 based on control signals, such as the converted clock signal from the clock converting circuit 49. Similar to the data loading circuit 42, the data output circuit 48 comprises a set of flip-flops, each set comprising a plurality of flip-flops coupled to the corresponding one of the bus lines $IB_0$–$IB_4$ for loading the output pixel data $b_{yx}$ in parallel. Thereafter, the data output circuit 48 serially provides the output pixel data $b_{yx}$ to the LCD panel 37.

The following is an example of the operation of the display format converting apparatus 40 when pixel data $a_{00}$, $a_{01}$, $a_{02}$ and $a_{03}$ of the input RGB image data is inputted on bus lines $I_0$–$I_3$, respectively. Each set of the plurality of flip flops coupled to each bus line serially loads the pixel data $a_{00}$–$a_{03}$ and the data loading circuit 42 outputs in parallel the loaded pixel data $a_{00}$–$a_{03}$ onto the bus lines $IA_0$–$IA_3$, respectively. The connection device 44*a*, 44*b*, 44*e* and 44*f* output $\frac{1}{4}a_{00}$, $\frac{1}{4}a_{01}$, $\frac{1}{4}a_{02}$ and $\frac{1}{4}a_{03}$, respectively, and the connection devices 44*c* and 44*d* output $\frac{1}{2}a_{01}$ and $\frac{1}{2}a_{02}$, respectively.

The adders 46*a*–46*e* of the data adding circuit 46 perform the following adding operation based on the outputs from the connection devices 44*a*–44*f* of the connection circuitry 44:

Output of adder 46*a*=$\frac{1}{4}a_{00}+\frac{1}{4}a_{01}$;

Output of adder 46*b*=$\frac{1}{2}a_{01}+\frac{1}{2}a_{02}$=output pixel data $b_{02}$;

Output of adder 46*c*=$\frac{1}{4}a_{00}+\frac{3}{4}a_{01}$=output pixel data $b_{01}$;

Output of adder 46*d*=$\frac{1}{4}a_{02}+\frac{1}{4}a_{03}$; and

Output of adder 46*e*=$\frac{3}{4}a_{02}+\frac{1}{4}a_{03}$=output pixel data $b_{03}$.

The output of adders 46*b*, 46*c* and 46*e* is transferred to the bus lines $IB_2$, $IB_1$ and $IB_4$, respectively. The loaded pixel data $a_{00}$ is directly transferred on bus line $IB_0$, and the loaded pixel data $a_{03}$ is directly transferred on bus line $IB_4$. Accordingly, the output pixel data $b_{00}$, $b_{01}$, $b_{02}$, $b_{03}$ and $b_{04}$, which are loaded into the data output circuit 48 and outputted to the LCD panel 37, are as follows:

$b_{00}=a_{00}$;

$b_{01}=\frac{1}{4}a_{00}+\frac{3}{4}a_{01}$;

$b_{02}=\frac{1}{2}a_{01}+\frac{1}{2}a_{02}$;

$b_{03}=\frac{3}{4}a02+\frac{1}{4}a_{03}$; and $b_{04}=a_{03}$.

As shown, the resultant pixel data $b_{01}$–$b_{04}$ is the same as the conversion illustrated in the matrix conversion rule. The above process is repeated for the remaining pixel data $b_{yx}$ to obtain the result of the weighted value conversion in the horizontal direction, and the partial amplification conversion in the vertical direction. Accordingly, the resultant 5×5 pixel data $b_{yx}$ equals the conversion of $a_x$ by Ty and Tx. The entire process is repeated for input pixel data for the 640×480 resolution to display the output image on the entire display area of the LCD panel 37 having 800×600 resolution.

By the above apparatus and method, the image data in a horizontal direction is converted in the display format by a prescribed weighted value and the image data in a vertical direction is partially amplified, thereby being displayed on the entire screen of the LCD panel 37, as shown in FIG. 3.

As per the image quality of the displayed screen having a converted format as above, the image converted from the original is displayed in uniform amplification, rather than being concentrated on a pixel at a particular portion.

In the display format converting apparatus according to the present invention, when image data of a low resolution is displayed on a screen having a high resolution, the image is displayed in a more uniform cell amplification, rather than a concentrated cell amplification. Hence, the image quality on the screen is improved.

For the partial amplification in a vertical direction, the two gates corresponding to the LCD panel 37 is concurrently driven. At a portion to be partially amplified, the image data is input concurrently to two pixels by opening two gates of the LCD at the same time, thereby shortening the time gap to display the image in the vertical direction. The format conversion is applied to the vertical direction and a concurrent loading is performed in the horizontal direction, thus incurring no change to the PC interface. Therefore, the present apparatus is readily applicable to a general high-pixel LCD device.

The foregoing embodiments are merely exemplary and are not to be construed as limiting the present invention. The present teaching can be readily applied to other types of displays having different resolutions than the above described preferred embodiment. The weighted values and partial amplification factors are intended to be illustrative for the preferred embodiment, and may be changed to meet the specific resolution of the particular display device. The description of the present invention is intended to be illustrative, and not to limit the scope of the claims. Many alternatives, modifications, and variations will be apparent to those skilled in the art.

What is claimed is:

1. A system for displaying an image, comprising:

an apparatus that outputs a plurality of first pixel data of a first prescribed resolution;

a converting apparatus coupled to said system, said converting apparatus assigning a plurality of weighted values to said plurality of pixel data in a first direction and partially amplifying said plurality of first pixel data in a second direction to output a plurality of second pixel data; and a display device coupled to said converting apparatus to receive the plurality of second pixel data, said display device displaying the image of a second prescribed resolution based on the plurality of second pixel data, wherein the first and second directions are different directions, wherein said converting apparatus comprises:

a data loading circuit coupled to said apparatus to receive the plurality of first pixel data;

a conversion circuit coupled to said data loading circuit, which converts the plurality of first pixel data to the plurality of second pixel data; and a data output circuit coupled to said conversion circuit to receive the plurality of second pixel data for output to said display device, wherein each of said plurality of first and second pixel data comprises a prescribed number of bits, and said conversion circuit comprises:

a connection circuitry coupled to said data loading circuit, said connection circuitry shifting the bits of corresponding first pixel data; and an arithmetic unit coupled to said connection circuitry, said arithmetic unit performs a prescribed arithmetic operation on the shifted first pixel data to output the plurality of second pixel data.

2. The system of claim 1, wherein the second resolution is higher than the first resolution.

3. The system of claim 1, wherein each of said plurality of first and second pixel data comprise a prescribed number of bits.

4. The system of claim 1, wherein the plurality of second pixel data has a greater number of pixel data than the plurality of first pixel data.

5. The system of claim 1, wherein said data loading circuit comprises sets of latches, each set having a plurality of latches to load corresponding bit of each first pixel data; and said connection circuitry includes:

a plurality of first connection devices coupled to corresponding sets of latches and shifting corresponding first pixel data by a first prescribed amount, and a plurality of second connection devices coupled to corresponding sets of latches, and shifting corresponding first pixel data by a second prescribed amount.

6. The system of claim 5, wherein corresponding first pixel data are directly transferred to said data output circuit from said data loading circuit.

7. The system of claim 5, wherein said latches are flip-flops.

8. The system of claim 5, wherein said first prescribed amount equals one, and said second prescribed amount equals two.

9. The system of claim 5, wherein said first and second connection devices comprises a network of data line connections to outputs of said plurality of latches.

10. The system of claim 1, wherein said arithmetic unit comprises a plurality of adders.

11. The system of claim 1, wherein said data output circuit comprises sets of latches, each set having a plurality of latches to load corresponding bits of each second pixel data.

12. The system of claim 1, wherein the first direction is a horizontal direction and the second direction is a vertical direction.

13. A converting apparatus for converting a plurality of pixel data for a first resolution to a plurality of pixel data for a second resolution of a display device, comprising:

a data loading circuit to receive the plurality of first pixel data;

a conversion circuit coupled to said data loading circuit, said conversion circuit assigning at least one of a plurality of weighted values and partially amplifying said plurality of first pixel data to output a plurality of second pixel data; and a data output circuit coupled to said conversion circuit to receive the plurality of second pixel data for output to the display device, wherein each of said plurality of first and second pixel data comprises a prescribed number of bits, and said conversion circuit comprises:

a connection circuitry coupled to said data loading circuit, said connection circuitry shifting the bits of corresponding first pixel data; and an arithmetic unit coupled to said connection circuitry, said arithmetic unit performs a prescribed arithmetic operation on the shifted first pixel data to output the plurality of second pixel data.

14. The converting apparatus of claim 13, wherein the plurality of second pixel data has a greater number of pixel data than the plurality of first pixel data.

15. The converting apparatus of claim 13, wherein said data loading circuit comprises sets of latches, each set having a plurality of latches to load corresponding bits of each first pixel data; and said connection circuitry includes:

a plurality of first connection devices coupled to corresponding sets of latches and shifting corresponding first pixel data by a first prescribed amount, and a plurality of second connection devices coupled to corresponding sets of latches, and shifting corresponding first pixel data by a second prescribed amount.

16. The converting apparatus of claim 13, wherein corresponding first pixel data are directly transferred to said data output circuit from said data loading circuit.

17. The converting apparatus of claim 13, wherein said latches are flip-flops.

18. The converting apparatus of claim 13, wherein said first prescribed amount equals one, and said second prescribed amount equals two.

19. The converting apparatus of claim 13, wherein said first and second connection devices comprises a network of data line connections to outputs of said plurality of latches.

20. The converting apparatus of claim 13, wherein said arithmetic unit comprises a plurality of adders.

21. The converting apparatus of claim 13, wherein said data output circuit comprises sets of latches, each set having a plurality of latches to load bits of each second pixel data.

22. The converting apparatus of claim 13, wherein the plurality of weighted values are assigned in a first direction of the plurality of first pixel data, which are amplified in a second direction, and wherein the first and second directions are different directions.

23. The converting apparatus of claim 22, wherein the first direction is a horizontal direction and the second direction is a vertical direction.

24. A method of converting a plurality of pixel data for a first display having a first resolution to a plurality of second pixel data for a second display having a second resolution, the method comprising the steps of:

(a) assigning a weighted value to the plurality of first pixel data in a first direction to output the plurality of second pixel data in a first direction of the second display; and (b) partially amplifying the plurality of first pixel data in a second direction to output the plurality of second pixel data in a second direction of the second display, wherein at least one of the steps (a) and (b) is performed by shifting the bits of corresponding first pixel data and wherein at least one of the steps (a) and (b) is performed by performing a prescribed arithmetic operation on the shifted first pixel data.

* * * * *